US007219503B2

(12) United States Patent
Albertson

(10) Patent No.: US 7,219,503 B2
(45) Date of Patent: May 22, 2007

(54) QUICK-CHANGE COALESCENT OIL SEPARATOR

(75) Inventor: Luther D. Albertson, Sellersburg, IN (US)

(73) Assignee: Redi Controls, Inc., Greenwood, IN (US)

( * ) Notice: Subject to any disclaimer, the term of this patent is extended or adjusted under 35 U.S.C. 154(b) by 197 days.

(21) Appl. No.: 11/116,837

(22) Filed: Apr. 28, 2005

(65) Prior Publication Data

US 2006/0242991 A1 Nov. 2, 2006

(51) Int. Cl.
*F25B 43/02* (2006.01)

(52) U.S. Cl. ..... 62/84; 62/470

(58) Field of Classification Search ..... 62/84, 62/192, 193, 195, 468, 470, 473; 210/167.32, 210/416.5; 55/282.2, 323, 421
See application file for complete search history.

(56) References Cited

U.S. PATENT DOCUMENTS

| | | | | | |
|---|---|---|---|---|---|
| 2,875,592 | A | * | 3/1959 | Olsen | 62/192 |
| 3,721,108 | A | * | 3/1973 | Kocher | 62/470 |
| 3,844,688 | A | * | 10/1974 | Bulkley et al. | 417/313 |
| 4,213,307 | A | | 7/1980 | Watson | |
| 4,419,865 | A | * | 12/1983 | Szymaszek | 62/193 |
| 4,581,903 | A | | 4/1986 | Kerry | |
| 4,906,264 | A | | 3/1990 | Szymaszek et al. | |
| 5,001,908 | A | * | 3/1991 | Mayer | 62/470 |
| 5,170,640 | A | | 12/1992 | Heitmann et al. | |
| 5,363,662 | A | | 11/1994 | Todack | |
| 5,368,746 | A | | 11/1994 | Gryder | |
| 5,404,730 | A | | 4/1995 | Westermeyer | |
| 5,709,091 | A | | 1/1998 | Todack | |
| 6,185,955 | B1 | * | 2/2001 | Yamamoto | 62/470 |
| 6,276,165 | B1 | * | 8/2001 | Nishijima et al. | 62/473 |
| 6,349,561 | B1 | * | 2/2002 | Huang et al. | 62/470 |
| 6,640,559 | B1 | | 11/2003 | McQuade | |
| 7,082,785 | B2 | * | 8/2006 | Nieter et al. | 62/470 |
| 2002/0026800 | A1 | | 3/2002 | Kasai et al. | |
| 2002/0134104 | A1 | | 9/2002 | Stenhouse | |

FOREIGN PATENT DOCUMENTS

JP 5-141792 A * 6/1993

* cited by examiner

*Primary Examiner*—Mohammad M. Ali
(74) *Attorney, Agent, or Firm*—Krieg DeVault, LLP

(57) ABSTRACT

A refrigeration system including a coalescent oil separator for removing oil from a refrigerant gas and oil mixture discharged from a compressor. Upon a pressure condition being exceeded a directional flow valve opens to allow the refrigerant gas and oil mixture to bypass the coalescent oil separator. There is included a method for servicing the coalescent oil separator without having to resort to shutting down the refrigeration system or removing the refrigerant material.

20 Claims, 3 Drawing Sheets

QUICK-CHANGE COALESCENT OIL SEPARATOR

FIELD OF THE INVENTION

The present invention relates generally to compression refrigeration systems including a coalescent oil separator. More specifically, one form of the present invention relates to a coalescent oil separator system that enables servicing of the separator without having to shut down or remove the refrigerant from the refrigeration system.

BACKGROUND OF THE INVENTION

Typically, refrigeration systems include a compressor for compressing a refrigerant gas, a condenser to cool and condense the compressed refrigerant gas to a refrigerant liquid and an evaporator for absorbing heat from a fluid to provide a chilled liquid for refrigeration of a desired area. Most compressors utilize an oil to lubricate the mechanical components and enhance the sealing interface between the components that are performing the necessary work on the refrigerant gas to raise its pressure. A portion of the oil used in the compressor for lubrication often becomes entrained with the refrigerant gas and is discharged from the compressor. This mixture of the oil and refrigerant gas may be carried from the compressor to the other components including the condenser and evaporator.

Oil, however, is not considered a refrigerant and the efficiency of the refrigeration system is reduced if the oil remains mixed with refrigerant gas as it moves through the system. Furthermore, if the oil travels from the compressor to the other components of the refrigerant system and is not returned to the compressor more oil will need to be added to the compressor in order to maintain the compressor performance; for the lack of oil may cause the compressor to fail.

Although there are many prior systems for separating oil from the refrigerant gas, there remains a need for an improved oil separation system for refrigeration systems. The present inventions satisfy this and other needs in a novel and unobvious way.

SUMMARY OF THE INVENTION

One form of the present invention contemplates an apparatus compromising: a refrigeration system including an evaporator, a condenser and a compressor, the compressor including a compressor discharge through which flows a mixture including refrigerant gas and an oil; a coalescent oil separator having an inlet in fluid communication with the compressor discharge and an outlet in fluid communication with the condenser, the coalescent oil separator separating at least a portion of the oil from the refrigerant gas; and a by-pass check valve disposed between the inlet and the outlet, the by-pass check valve is normally closed but opens when the fluid pressure controlling its operation exceeds a threshold value thereby allowing the refrigerant gas and oil to bypass the coalescent oil separator and flow to the condenser.

Another form of the present invention contemplates an apparatus comprising: at least one refrigeration system including an evaporator, a condenser and a compressor, the compressor has a compressor discharge through which flows a fluid including a refrigerant gas and an oil; a coalescent oil separator having an inlet in fluid communication with the compressor discharge and an outlet in fluid communication with the condenser, the coalescent oil separator separating at least a portion of the oil from the refrigerant gas; a first valve disposed between the compressor discharge and the inlet and being operable to block the flow of the fluid to the coalescent oil separator; a second valve disposed between the outlet and the condenser and being operable to block fluid flow from the outlet; and a by-pass check valve disposed between the first valve and the second valve, the by-pass check valve is normally closed but opens when the pressure acting on the by-pass valve exceeds a threshold value to allow the fluid to flow through a passageway around the coalescent oil separator and to the condenser.

In yet another form the present invention contemplates a method for servicing a coalescent oil separator utilized to separate oil from a refrigerant gas and oil mixture that is discharged from a compressor within a refrigeration system, comprising: diverting the refrigerant gas and oil mixture from the compressor around the coalescent oil separator to a condenser of the refrigeration system; blocking the flow of the refrigerant gas and oil from the compressor to an inlet of the coalescent oil separator; blocking the flow from a coalescent oil separator outlet, the coalescent oil separator outlet is normally in fluid communication with the condenser; and servicing the coalescent oil separator during the diverting.

These and other objects of the present invention will become more apparent from the following description of the illustrative embodiment.

DESCRIPTION OF THE ILLUSTRATIVE EMBODIMENTS

Figure 1:
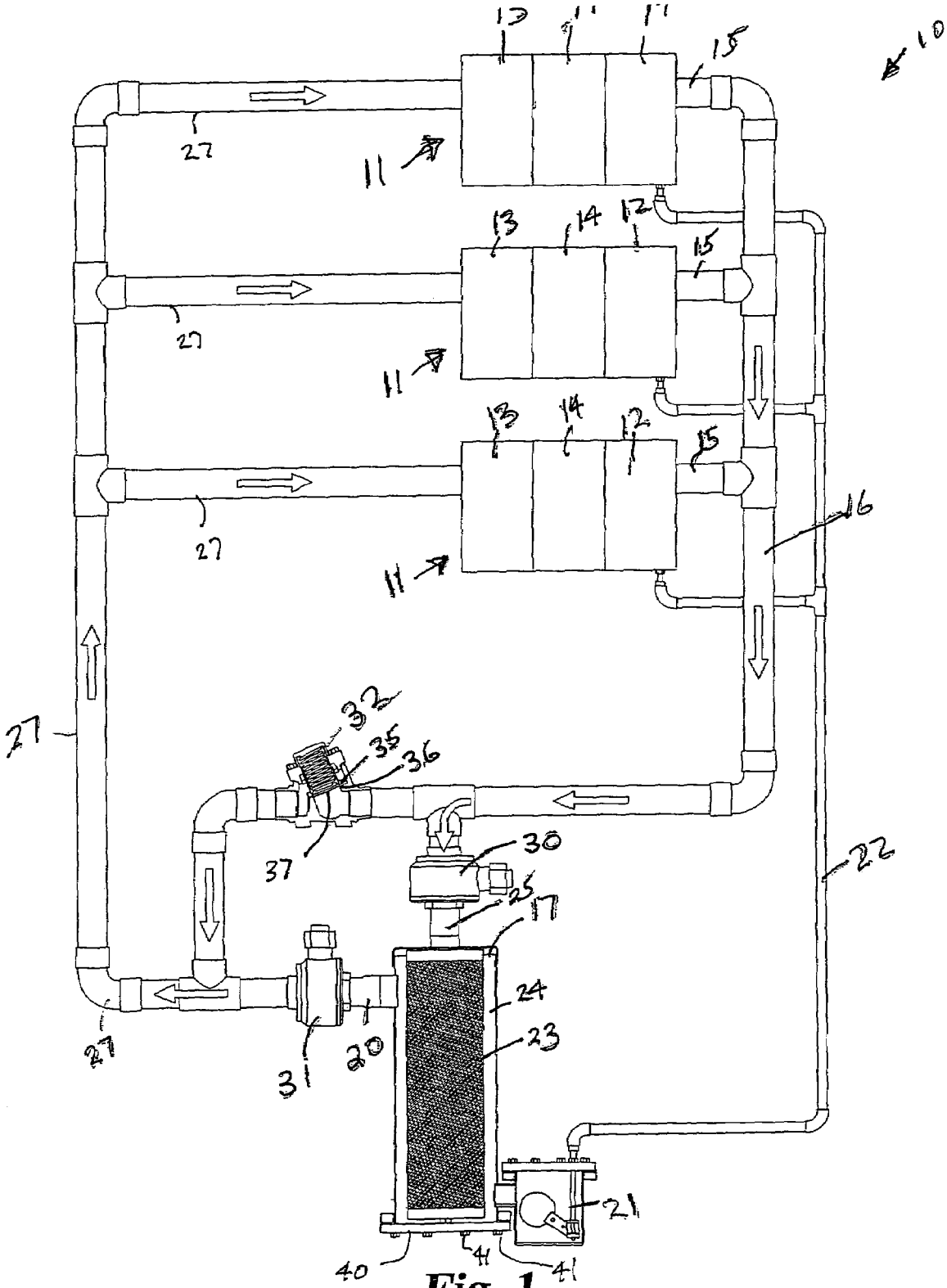
FIG. 1 is a schematic view of one embodiment of a coalescent oil separator system coupled in fluid communication with a compression cycle refrigeration system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

With reference to FIG. 1, is illustrated one form of a supermarket rack refrigeration system 10. The supermarket rack refrigeration system 10 includes a plurality of compression cycle refrigeration systems 11. The present application will utilize the supermarket rack refrigeration system as an illustrative embodiment, however the present application is not intended to be limited to this specific refrigeration system application and/or to including a plurality of refrigeration systems 11. The present application contemplates that the number of refrigeration systems can be one or more.

Each of the compression cycle refrigeration systems 11 includes three primary components, a compressor 12, a condenser 13 and an evaporator 14. The components are coupled together in a closed loop system through which flows a refrigerant gas. The compressor 12 compresses the refrigerant gas from a relatively lower pressure gaseous state to a relatively higher pressure gaseous state. The refrigerant gas exits the compressor 12 through the compressor discharge 15 and ultimately flows to the condenser 13. At the condenser 13 energy is removed from the refrigerant gas to facilitate the condensation of the refrigerant gas into a liquefied refrigerant. The liquefied refrigerant flows through an expansion device (not illustrated) into the evaporator 14 where the liquid refrigerant absorbs energy and evaporates; thereby functioning to cool an area associated with the evaporator 14. The liquid refrigerant has returned to the gaseous state and now flows from the evaporator 14 to the compressor 12 where the compressor is operable to increase the pressure to the relatively higher pressure gaseous state. Further information regarding the general operation of compression cycle refrigeration systems is not set forth herein as the information is believed generally known to those of ordinary skill in the art.

The compressor 12 includes a mechanical structure that is moved to do work on the relatively lower pressure refrigerant gas to increase the pressure to a relatively higher pressure refrigerant gas. In one form the moveable mechanical structure may include a reciprocating piston that moves relative to a cylinder bore. An oil is used between the piston and the cylinder bore to reduce the friction and enhance the seal between the respective components. The term oil as utilized herein is intended to broadly define a lubricant that may be synthetic based, petroleum based, of a single or multi-viscosity and may include a variety of additives. During the normal operation of the compressor 12, some of the oil is mixed with the refrigerant gas and is discharged through the compressor discharge 15. The refrigerant gas and oil mixture discharged from the compressor 12 may also include other contaminants.

In one form of the present invention, the fluid discharged from the compressor 12 includes the relatively higher pressure refrigerant gas and a quantity of the oil entrained therein. It should be understood herein that the fluid discharged from the compressor does not have to have a consistent amount of oil or other contaminants entrained therein The fluid exits the compressor discharge 15 and is passed through a fluid flow passageway 16 to an inlet 25 of a coalescent oil separator 17 and then to the coalescent oil separator 17. Within the coalescent oil separator 17 the oil and/or other contaminants and/or other materials are substantially removed from the fluid mixture to yield a refrigerant gas that passes out of the coalescent oil separator outlet 20. Upon completion of the separation process within the coalescent oil separator 17 the refrigerant gas flows out of the coalescent oil separator outlet 20 and through a passageway 27 to the condenser 13. In one form the separated oil is collected in an oil return housing 21 and subsequently returned to compressor 12 through an oil return line 22.

With reference to the embodiment of refrigeration system 10 depicted in FIG. 1, there is included a plurality of refrigeration systems 11 that each have their compressor discharges 15 connected in fluid communication with the passageway 16. The fluid exiting each of the compressor discharges 15 passes from the passageway 16 into the coalescent oil separator 17, and after being processed in the coalescent oil separator 17 is returned to the condensers 13 through passageway 27. However, as previously discussed the present application contemplates that the system may include one or more refrigeration systems 11 and there is no intention herein to limit the present application to a system including a plurality of refrigeration systems, unless specifically provided to the contrary.

Significant details regarding coalescent oil separators are believed generally known to one of ordinary skill in the art and therefore will not be recited in this document. The coalescent oil separator 17 includes a removable filter 23 that is located within a fluid tight mechanical housing 24 has a removable cover plate 40. In one form the cover plate 40 is secured to the mechanical housing 24 by a plurality of fasteners 41. The removable filter 23 includes a fine glass matrix type material capable of filtering out, but not limited to, liquid droplets, small particles and material/contaminants from the refrigerant gas within the fluid flow. More preferably the filter 23 removes the oil mixed with the refrigerant gas. In one preferred form the filter 23 is formed of a borosilicate material that can filter out liquid droplets, small particles and/or material/contaminants from the refrigerant gas down to about 0.3 microns. Coalescent oil separator filters due to their extremely fine particle filtering capability are prone to be plugged and/or clogged by the material separated by the filter from the fluid being processed. The plugging and/or clogging of the filter 23 causes an increase in the pressure drop across the filter.

A one way by-pass check valve 32 is disposed in fluid communication with the compressor discharge fluid in the passageway 16. The compressor discharge fluid acts on the surface 37 and when the pressure exceeds a predetermined threshold the check valve 32 opens to allow the compressor discharge fluid to flow around the coalescent oil separator 17. The check valve 32 is normally closed with the valve body 35 disposed in sealing contact with the valve seat 36. With the check valve 32 in the normally closed position the compressor discharge fluid passes into the coalescent oil separator 17. As the filter 23 becomes blocked and/or clogged the pressure acting on the surface 37 increases. When the pressure acting on the surface 37 exceeds a threshold value the valve body 35 moves from the valve seat 36 and fluid flows through the valve 32. The check valve 32 in one form is a spring actuated valve. The check valve 32 is calibrated to open at threshold values that have been selected for the individual system. In one form of the present invention the check valve 32 opens at about 10 PSIG. However, it is contemplated herein that the check valve 32 can open at a variety of other pressures as required by the system design.

Figure 2:
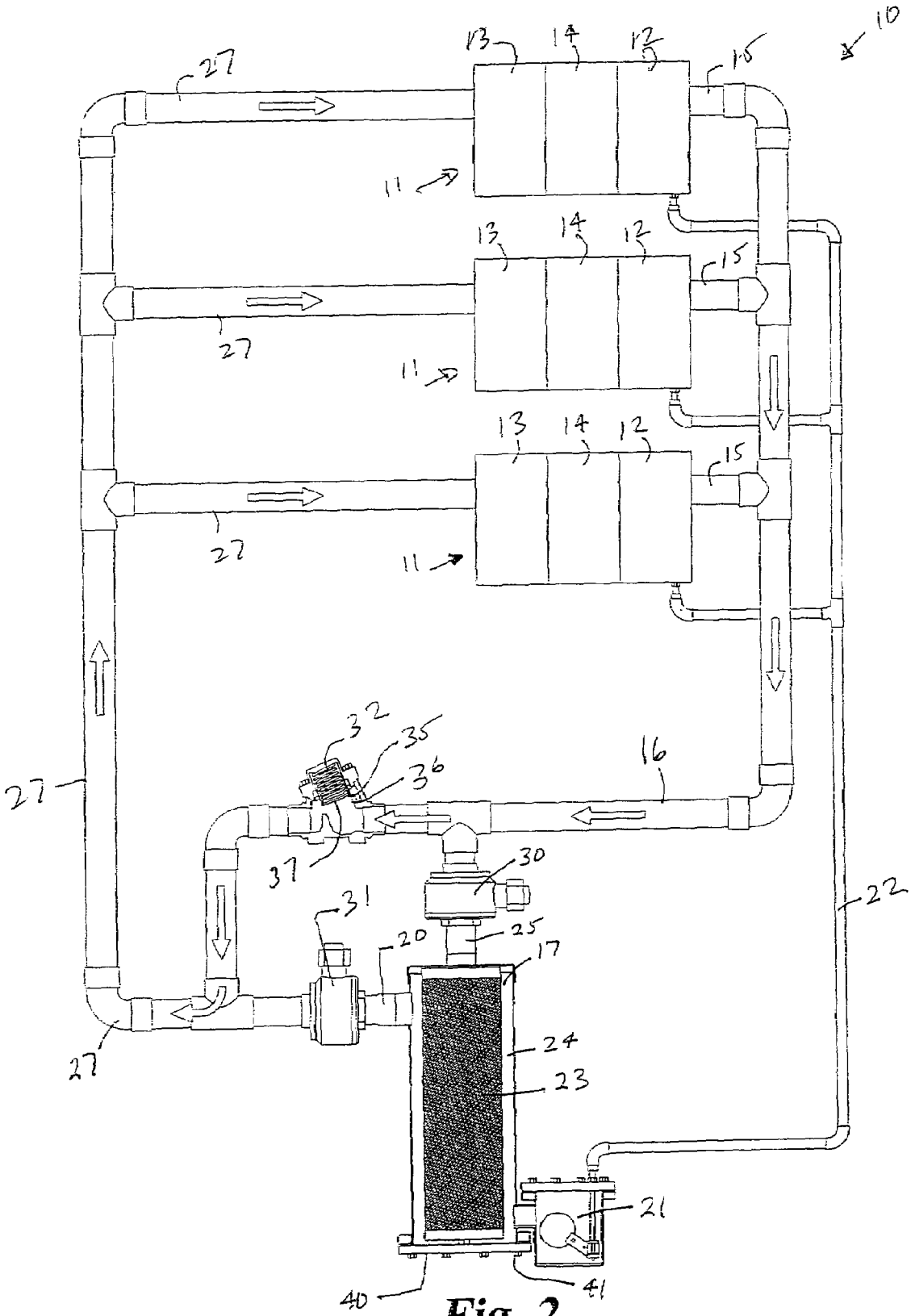
FIG. 2 is a schematic view of the system of FIG. 1 wherein the bypass check vale is in an open state.

With reference to FIG. 2, there is illustrated the system 10 with the check valve 32 in an open state. In the open state the compressor discharge fluid bypasses coalescent oil separator 17. The check valve 32 will open upon the pressure acting on the surface 37 being above a threshold value so that the valve body 35 moves from the seat 36. In one situation the filter 23 becomes clogged or plugged to an extent that the pressure in passageway 16 acting upon surface 37 exceeds a predetermined threshold value and the valve opens.

Figure 3:
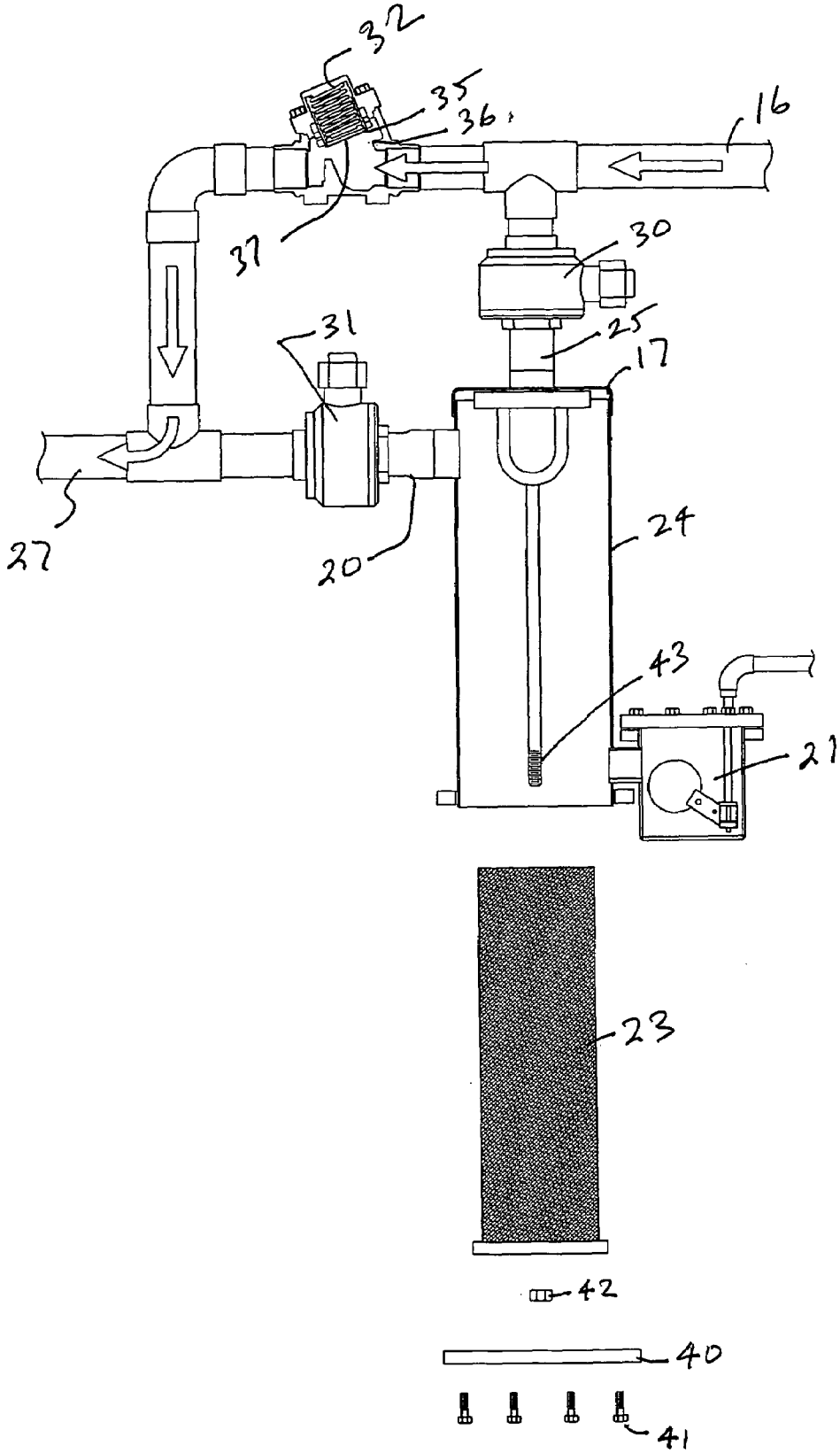
FIG. 3 is an enlarged partially exploded view of the coalescent oil separator system of FIG. 2.

With reference to FIGS. 1–3, there is illustrated that in one form of the present invention there is included a valve 30 prior to the coalescent oil separator inlet 25 and a valve 31 after the coalescent oil separator outlet 20. The present application also contemplates a system without either of these valves. The valve 30 is operable to control the flow of compressor discharge fluid to the coalescent oil separator inlet 25. Upon the valve 30 being in the open state the compressor discharge fluid flow to the coalescent oil separator inlet 25 is not blocked, and when the valve 30 is in a closed state the fluid flow to the coalescent oil separator inlet 25 is blocked. Valve 31 is located between the coalescent oil separator outlet 20 and the condenser 13. Upon the valve 31 being in a open state the fluid flow from the coalescent oil separator outlet inlet 20 is not blocked, and when the valve 31 is in a closed state the fluid flow from the coalescent oil separator outlet 20 is blocked. In one form of the present invention the valves 30 and 31 are full flow ball type valves. However, other types of valves are contemplated herein. The check valve 32 is located between the valves 30 and 31 in one form of the present invention the valves 30 and 31 are in a normally open state.

In order to service the coalescent oil separator 17 without having to shut down the refrigeration systems 11 or reclaim the refrigerant the valves 30 and 31 are closed. The closing of the valves 30 and 31 isolates the coalescent oil separator 17 from the rest of the refrigerant system 10, and causes the check valve 32 to open and diverts the compressor discharge fluid around the coalescent oil separator 17. Since the systems have not been shut down or purged of the refrigerant material the pressurized refrigerant gas within the system bypasses the oil coalescent separator 17 and proceeds to the respective condensers 13.

With reference to FIGS. 2 and 3, there is illustrated the one way check valve 32 in an open state to allow the bypass of compressor discharge fluid around the coalescent oil separator 17. The valves 30 and 31 have both been closed to isolate the coalescent oil separator 17 from the rest of the system. However, it should be understood herein that the closing one or both of the valves 30 and 31 may result in the fluid pressure acting on surface 37 rising to a level sufficient to cause check valve 32 to open. However, it is also possible that valves 30 and 31 may be maintained in a fully open state and that the filter 23 within the oil coalescent separator 17 becomes plugged to an extent that the drop in pressure across the filter 23 causes pressure in line 16 to exceed the threshold pressure and valve 32 is opened.

In the system depicted in FIG. 3, the valves 30 and 31 have been closed to block fluid flow to or from the coalescent oil separator 17 and the one way check valve 32 has opened due to the fluid pressure acting thereon. The refrigeration systems 11 have not been shut down nor have the systems 11 had their refrigerant removed. However, the present application also contemplates that one or more of the refrigeration systems may not be running. Therefore it should be understood that the servicing and/or changing of the filter 23 and/or the coalescent oil separator 17 is occurring with the system in a normal operating condition.

In one form of the present invention the bottom plate 40 is removed from the housing 23 by the removal of the plurality of fasteners 41. With the bottom plate 40 removed the coalescent oil separator filter 23 is assessable and is removed by removing a nut 42 from the threaded rod 43. Thereafter the coalescent oil separator filter 23 can be removed from the housing 24 and serviced or replaced with a fresh filter. Upon completion of the servicing of the filter 23 the nut 42 is reinstalled and the bottom plate 40 is secured with fasteners 41 to the housing 24. Valves 30 and 31 are then opened to allow the passage of fluid into and out of the coalescent oil separator 17. In the event that one of the valves 30 and 31 is left inadvertently closed, the one way check valve 32 will open and allow the fluid to bypass around the coalescent oil separator 17. Further, the same general procedure may be used to repair or replace the coalescent oil separator 17.

The passageways 27 and 16 and the oil return line may be formed of a variety of piping and tubing. Further, the routing of the passageways is illustrative and other configurations are contemplated herein.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus compromising:

a refrigeration system including an evaporator, a condenser and a compressor, said compressor including a compressor discharge through which flows a mixture including refrigerant gas and an oil;

a coalescent oil separator having an inlet in fluid communication with said compressor discharge and an outlet in fluid communication with said condenser, said coalescent oil separator separating at least a portion of the oil from the refrigerant gas; and a by-pass check valve disposed between said inlet and said outlet, said by-pass check valve is normally closed but opens when the fluid pressure controlling its operation exceeds a threshold value thereby allowing the refrigerant gas and oil to bypass said coalescent oil separator and flow to said condenser.

2. The apparatus of claim 1, wherein said by-pass check valve is a one way spring biased valve.

3. The apparatus of claim 1, wherein said coalescent oil separator includes a filter capable of filtering out material down to about 0.3 microns.

4. The apparatus of claim 1, wherein said refrigeration system defines a plurality of refrigeration systems, each of said plurality of refrigeration systems including an evaporator, a condenser and a compressor having a compressor discharge through which flows a mixture including refrigerant gas and an oil; and wherein each of said compressor discharges are in fluid flow communication with said inlet.

5. The apparatus of claim 1, wherein the fluid pressure controlling the operation of said by-pass check valve is from the refrigerant gas and oil from the compressor discharge.

6. An apparatus comprising:

at least one refrigeration system including an evaporator, a condenser and a compressor, said compressor has a compressor discharge through which flows a fluid including a refrigerant gas and an oil;

a coalescent oil separator having an inlet in fluid communication with said compressor discharge and an outlet in fluid communication with said condenser, said coalescent oil separator separating at least a portion of the oil from the refrigerant gas;

a first valve disposed between said compressor discharge and said inlet and being operable to block the flow of the fluid to said coalescent oil separator;

a second valve disposed between said outlet and said condenser and being operable to block fluid flow from said outlet; and a by-pass check valve disposed between said first valve and said second valve, said by-pass check valve is normally closed but opens when the pressure acting on the by-pass valve exceeds a threshold value to allow the fluid to flow through a passageway around said coalescent oil separator and to said condenser.

7. The apparatus of claim 6, wherein said at least one refrigeration system defines a plurality of refrigeration systems;

wherein each of said compressor discharges are in fluid communication with said inlet;

wherein each of said condensers are in fluid communication with said outlet.

8. The apparatus of claim 7, wherein the fluid flow from each of said compressor discharges is piped in serial flow to said inlet.

9. The apparatus of claim 6, wherein said by-pass check valve is a spring calibrated directional flow check valve; and wherein each of said first and second valves is a full flow ball valve.

10. The apparatus of claim 6, wherein said coalescent oil separator includes a removable fine glass matrix material filter.

11. The apparatus of claim 10, wherein said removable fine glass matrix material filters out material down to about 0.3 microns in size.

12. The apparatus of claim 6, wherein upon closing at least one of said first and second valves will cause the pressure acting on the by-pass valve to exceed the threshold value and open the by-pass check valve.

13. A method for servicing a coalescent oil separator utilized to separate oil from a refrigerant gas and oil mixture that is discharged from a compressor within a refrigeration system, comprising:

diverting the refrigerant gas and oil mixture from the compressor around the coalescent oil separator to a condenser of the refrigeration system;

blocking the flow of the refrigerant gas and oil from the compressor to an inlet of the coalescent oil separator;

blocking the flow from a coalescent oil separator outlet, the coalescent oil separator outlet is normally in fluid communication with the condenser; and servicing the coalescent oil separator during said diverting.

14. The method of claim 13, wherein said diverting includes opening a directional flow valve.

15. The method of claim 13, wherein said servicing includes changing a filter within the coalescent oil separator.

16. The method of claim 15, wherein said changing includes removing a cover from the coalescent oil separator to gain access to the filter; and detaching the filter from a mechanical structure within the coalescent oil separator.

17. The method of claim 14, wherein in said diverting the refrigerant gas and oil mixture exerts fluid pressure upon the directional flow valve, and upon the fluid pressure exceeding a threshold limit of the directional flow valve the valve opens to allow the refrigerant gas and oil mixture to flow therethrough.

18. The method of claim 13, wherein during said servicing the refrigerant gas and oil mixture is being bypassed around the coalescent oil separator in said diverting act.

19. The method of claim 13, wherein each of said blocking involves closing a valve.

20. The method of claim 13, wherein said diverting includes opening a one way check valve;

wherein said servicing includes one of replacing or refurbishing a filter within the coalescent oil separator; and wherein in said diverting the refrigerant gas and oil mixture exerts the fluid pressure acting upon the one way check valve, and when the fluid pressure overcomes the threshold limit of the one way check valve the valve opens to allow the refrigerant gas and oil mixture to flow therethrough.

* * * * *